US009004175B2

(12) United States Patent
Abel

(10) Patent No.: US 9,004,175 B2
(45) Date of Patent: Apr. 14, 2015

(54) METHOD AND SYSTEM FOR RAPID CONTAINMENT AND INTERVENTION OF A SUBSEA WELL BLOWOUT

(71) Applicant: Leo William Abel, Houston, TX (US)

(72) Inventor: Leo William Abel, Houston, TX (US)

( * ) Notice: Subject to any disclaimer, the term of this patent is extended or adjusted under 35 U.S.C. 154(b) by 221 days.

(21) Appl. No.: 13/749,417

(22) Filed: Jan. 24, 2013

(65) Prior Publication Data

US 2013/0192843 A1 Aug. 1, 2013

Related U.S. Application Data

(60) Provisional application No. 61/592,449, filed on Jan. 30, 2012.

(51) Int. Cl.
*E21B 33/035* (2006.01)

(52) U.S. Cl.
CPC ..... *E21B 33/035* (2013.01); *E21B 33/0355* (2013.01)

(58) Field of Classification Search
CPC ..... E21B 43/0122
USPC ..... 166/338, 344, 345, 347, 363, 364, 368; 251/1.1
See application file for complete search history.

(56) References Cited

U.S. PATENT DOCUMENTS

| | | | | |
|---|---|---|---|---|
| 4,324,505 | A | 4/1982 | Hammett | |
| 8,720,580 | B1 * | 5/2014 | Lugo | 166/344 |
| 2011/0100637 | A1 | 5/2011 | Gustafson | |
| 2012/0001100 | A1 | 1/2012 | Hubbell, Jr. | |
| 2012/0018165 | A1 | 1/2012 | Crossley et al. | |
| 2013/0299177 | A1 * | 11/2013 | Lyle | 166/338 |

FOREIGN PATENT DOCUMENTS

WO 2011163573 A2 12/2011

* cited by examiner

*Primary Examiner* — James G Sayre
(74) *Attorney, Agent, or Firm* — Buskop Law Group, PC; Wendy Buskop

(57) ABSTRACT

A method and system for rapid containment and intervention of a subsea well blowout that can be performed in a rapid and efficient manner, where containment will minimize the damage to the environment and assets. The method can include disconnecting a riser from a subsea well after a blowout has occurred and moving the mobile offshore drilling unit away from the subsea well. Connecting a lower marine riser package with a blowout preventer, and diverting the well. The pressure and flow of the well fluid can be observed. At least of portion of the diversion path can be closed off and kill fluid and or cement pumped to the subsea well to kill and control the well.

10 Claims, 7 Drawing Sheets

FIGURE 13

| | |
|---|---|
| DISCONNECTING A RISER FROM A SUBSEA WELL AFTER A BLOWOUT HAS OCCURRED | 1302 |
| MOVING A MOBILE OFFSHORE DRILLING UNIT A SHORT DISTANCE AWAY FROM THE SUBSEA WELL | 1304 |
| PULLING THE RISER AND A CONNECTED LOWER MARINE PACKAGE SYSTEM ONTO THE MOBILE OFFSHORE DRILLING UNIT | 1306 |
| MODIFYING A LOWER MARINE RISER PACKAGE INTO A LOWER MARINE RISER PACKAGE CAPPING SYSTEM USING COMMON EXISTING EQUIPMENT | 1308 |
| RUNNING THE LOWER MARINE RISER PACKAGE CAPPING SYSTEM ON A DRILL PIPE TO AN INITIAL POSITION NEAR THE SEABED, WHEREIN THE LOWER MARINE RISER PACKAGE CAPPING SYSTEM ON THE DRILL PIPE IS VERTICALLY POSITIONED ABOVE A BLOWOUT CONNECTOR OF A BLOWOUT PREVENTER CONNECTED TO THE SUBSEA WELL BLOWOUT IN THE INITIAL POSITION, IN THE INITIAL POSITION THE LOWER MARINE RISER PACKAGE CAPPING SYSTEM ON THE DRILL PIPE IS OFFSET HORIZONTALLY FROM THE BLOWOUT CONNECTOR OF THE BLOWOUT PREVENTER | 1310 |
| MOVING THE MOBILE OFFSHORE DRILLING UNIT OVER THE SUBSEA WELL TO OPERATIVELY ALIGN THE LOWER MARINE RISER PACKAGE CAPPING SYSTEM WITH THE BLOWOUT PREVENTER | 1312 |
| OPERATIVELY ENGAGING THE LOWER MARINE RISER PACKAGE CAPPING SYSTEM WITH THE BLOWOUT PREVENTER | 1314 |
| ALLOWING AN EFFLUENT TO FLOW THROUGH A FIRST FLOW PATH IN THE LOWER MARINE RISER PACKAGE CAPPING SYSTEM WHEN THE LOWER MARINE RISER PACKAGE CAPPING SYSTEM IS ENGAGED WITH THE BLOWOUT PREVENTER | 1316 |
| ALLOWING THE EFFLUENT TO FLOW THROUGH A DIVERSION FLOW PATH IN THE LOWER MARINE RISER PACKAGE CAPPING SYSTEM | 1318 |
| STOPPING THE EFFLUENT FROM FLOWING THROUGH THE FIRST FLOW PATH OF THE LOWER MARINE RISER PACKAGE CAPPING SYSTEM | 1320 |
| OBSERVING DIVERSION OF THE EFFLUENT FLOW AND PRESSURE THROUGH THE LOWER MARINE RISER PACKAGE CAPPING SYSTEM | 1322 |
| CLOSING OFF AT LEAST A PORTION AND/OR BLANKING OFF THE DIVERSION FLOW PATH | 1324 |
| PUMPING FLUID INTO THE SUBSEA WELL TO KILL THE SUBSEA WELL BLOWOUT | 1326 |

METHOD AND SYSTEM FOR RAPID CONTAINMENT AND INTERVENTION OF A SUBSEA WELL BLOWOUT

CROSS REFERENCE TO RELATED APPLICATIONS

The present application claims priority to and the benefit of U.S. Provisional Patent Application Ser. No. 61/592,449 filed on Jan. 30, 2012, entitled "METHOD AND SYSTEM FOR RAPID WELL CONTAINMENT OF A SUBSEA WELL BLOWOUT." This reference is incorporated herein in its entirety.

FIELD

The present embodiments generally relate to a method and system for rapid containment and intervention of a subsea well blowout.

BACKGROUND

A need exists for a method and system for rapid containment and intervention of a subsea well blowout that utilizes existing drilling equipment.

A further need exists for a method and system for rapid containment and intervention of a subsea well that allows for a mobile offshore drilling unit to be self-sufficient in the intervention process.

The present embodiments meet these needs.

BRIEF DESCRIPTION OF THE DRAWINGS

The detailed description will be better understood in conjunction with the accompanying drawings as follows:

FIG. 13 is a diagram depicting the steps of the present method.

Figure 1:
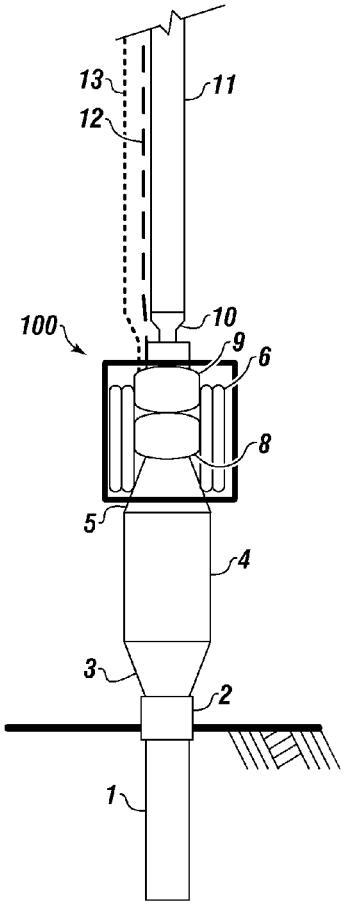
FIGURE 1 PRIOR ART
FIG. 1 depicts a schematic of a normal arrangement of a subsea blowout preventer that includes a blowout preventer stack, a lower marine riser package, and a riser.

The present embodiments are detailed below with reference to the listed Figures.

DETAILED DESCRIPTION OF THE EMBODIMENTS

Before explaining the present method and system in detail, it is to be understood that the method and system are not limited to the particular embodiments and that the embodiments can be practiced or carried out in various ways.

The present embodiments generally relate to a method and system for rapid containment and intervention of a subsea well blowout.

The method for rapid containment and intervention of the subsea well can include disconnecting a lower marine riser package (LMRP) from the subsea well after a blowout has occurred. The LMRP and a riser can be disconnected from a subsea blowout preventer (subsea BOP) connected with a wellhead of the subsea well using common techniques known to one skilled in the art via a marine connector.

The method can include moving the mobile offshore drilling unit (MODU) away from the subsea well after the LMRP has been disconnected.

The method can also include retrieving the riser and the connected LMRP. The riser and connected LMRP can be stored onboard in an operation area of the MODU.

The method can include connecting certain devices common to the art of drilling operations to the LMRP that adapt the LMRP to form the lower marine riser package capping system.

The lower marine riser package capping system can be run on drill pipe and reconnected to the subsea BOP for rapid containment and intervention of the subsea well blowout. The lower marine riser package capping system can be referred to generally as a capping system.

The lower marine riser package capping system can include a connector configured to connect to the subsea BOP. The connector can be any ordinary and normally supplied connector used in subsea well drilling operations.

A capping blowout preventer can be attached to the connector. In one or more embodiments, the capping blowout preventer can be an assembly having a plurality of single cavity blowout preventers and a spool piece with large diameter outlets. In one or more embodiments, the capping blowout preventer can be a double cavity blowout preventer. The double cavity blowout preventer can have blinds in two cavities. The capping blowout preventer can be any appropriate capping blowout preventer. For example, the capping blowout preventer can be a commercially available capping blowout preventer or another device configured to function similar to the capping blowout preventer. The capping blowout preventer can have two blind rams configured to block flow through a bore of the capping blowout preventer. The capping blowout preventer can be actuated using hydraulic fluid under pressure that can be sourced from an accumulator and or a pump conveyed from a remote operated vehicle (ROV).

The capping blowout preventer can have a diverter line in fluid communication therewith. The diverter line can be configured to allow well fluid to be diverted out of the capping blowout preventer when that capping blowout preventer is closed. For example, as the double blind rams of the capping blowout preventer are closed, the diverter line can allow the well fluid to flow out of side outlets of the capping blowout preventer, thereby reducing pressure and flow within the capping blowout preventer.

An inboard first diverter valve can be connected with the capping blowout preventer and the diverter line. The inboard first diverter valve can be used to control communication between the capping blowout preventer and the diverter line.

A first choke can be operatively positioned on an end of the diverter line. The first choke can be used to control flow of the diverter line. For example, a flow area of the first choke can be reduced to reduce a flow rate of the well fluid out of the diverter line, or the flow area of the first choke can be increased to increase the flow rate of the well fluid out of the diverter line. The first choke can be a hydraulically operated choke.

The first choke can be connected with the diverter line via a lower flow cross. The lower flow cross can be a three way block, a four way block, or the like.

An outboard first diverter valve can be disposed between the first choke and the diverter line. The outboard first diverter valve can be any device used to control fluid communication between the capping blowout preventer and the diverter line. The outboard first diverter valve can be hydraulically operated or the like. The outboard first diverter valve can be connected with the lower flow cross and the first choke.

An inboard second diverter valve can be in fluid communication with the capping blowout preventer, and an outboard second diverter valve can be adjacent and in fluid communication with the inboard second diverter valve.

A second choke can be adjacent and in fluid communication with the outboard second diverter valve.

One or more lower marine riser package annular preventers can be connected with the capping blowout preventer. The lower marine riser package annular preventers can be any that are normally provided in the drilling operation of subsea wells, and can provide required mass and stability to the lower marine riser package capping system.

A slotted riser diverter section can be connected with the lower marine riser package (LMRP). The slotted riser diverter section can be any commercially available slotted riser diverter section that is compatible with the riser system. For example, the slotted riser diverter section can be a short riser section converted to a diverter, such as by placing several large perforations which create flow area therethrough.

An outboard pump line valve can be connected with an inboard pump line valve. The inboard pump line valve can be in fluid communication with drill pipe. The inboard pump line valve can be connected with an upper flow cross located between the drill pipe and the slotted riser diverter section.

A pump line can be in fluid communication with the outboard pump line valve and the diverter line.

An emergency disconnect tool can be connected with the end of the drill pipe. The emergency disconnect tool can be any commercially available on-off tool that allows the drill pipe to be dis-engaged by mechanical action (turning and pulling tension) or by other means, such as hydraulics, explosive charge, or electrical systems. The emergency disconnect tool can be used to abandon operations if there is a need to move the MODU off location during the use of the LMRP capping system after it has been landed on the subsea BOP stack for operational needs or for emergency reasons.

A lower crossover can be connected between the connector and the capping blowout preventer, and an upper crossover connected between the slotted riser diverter section and the capping blowout preventer.

The diverter valves, flow valves, capping blowout preventer, connector, and choke can be controlled by hydraulic lines, electric control lines, remote operated vehicles, acoustic control systems, or combinations thereof.

In one or more embodiments, a lower riser package capping system can include a remote operated vehicle operator panel, which can be operatively connected to the subsea BOP, the connector, the lower crossover, the upper crossover, or combinations thereof. The remote operated vehicle panel can be configured to allow for control opening or closing one or more rams in the capping blowout preventer, the first choke, the second choke, the inboard first diverter valve, the inboard second diverter valve, the outboard first diverter valve, the outboard second diverter valve, the inboard pump line valve, the outboard pump line valve, marine connector, chemical injection port, stab-in for pumping to recharge accumulator pressure or to operate any or all of the hydraulic controlled devices on the lower riser package capping system or combinations thereof. The remote operated vehicle panel can also be equipped with gauges that display pressures in the hydraulic systems, well pressure at various locations on the lower riser package capping system and temperatures in and out of the lower riser package capping system.

In one or more embodiments, the lower riser package capping system can include an acoustic system. The acoustic system can measure and report pressure and temperature within the lower riser package capping system and/or control the connector and the functions of the blowout preventer, the first choke, the second choke, the inboard first diverter valve, the inboard second diverter valve, the outboard first diverter valve, the outboard second diverter valve, the inboard pump line valve, the outboard pump line valve, or combinations thereof.

The method can include running the lower marine riser package capping system by suspending the lower marine riser package capping system with drill pipe used in ordinary drilling operations, such as by connecting the drill pipe to the lower marine riser package capping system in a vertical position above a leaking subsea BOP. The leaking subsea BOP can be operatively connected with the subsea well in a common technique referred to as landing the subsea BOP.

The MODU can be moved to a position near the subsea well to operatively align the drill pipe and the connected lower marine riser package capping system with the subsea BOP. For example, a centerline of the lower marine riser package capping system can be aligned with a centerline of the subsea BOP. The drill pipe and the connected lower marine riser package capping system can be considered operatively aligned when the connector is capable of connecting with the subsea BOP.

The lower marine riser package capping system can be operatively engaged with the leaking subsea BOP. For example, a hydraulic actuated marine connector can be used to engage the lower marine riser package capping system with the subsea BOP.

After the subsea BOP and the lower marine riser package capping system are engaged, the well fluid can be diverted through the bore of the lower marine riser package capping system. For example, the fluid flow can be diverted out of the slotted riser diverter section.

After the capping blowout preventer is actuated, is being actuated, or both, the well fluid can be diverted through the first inboard first diverter valve, the outboard first diverter valve, and the diverter line and the first choke. In addition, the fluid can be diverted out of the inboard second diverter valve, the outboard second diverter valve, and the second choke.

The method can include observing the flow of well fluid, the temperature of the well fluid, the pressure of the well fluid, other well conditions, or combinations thereof via a remote operated vehicle camera, an acoustic pressure and temperature system, or combinations thereof.

The method can also include closing off at least a portion of the diverter line, and pumping the kill fluid into the well to kill the well via known techniques. Illustrative techniques can include pumping into the well from the MODU via the drill pipe with various types of fluids, cementing, reactive chemicals, or the like.

At least a portion of the diverter line can be closed off by closing the first choke, the second choke, the outboard first diverter valve, the inboard second diverter valve, and the outboard second diverter valve. Pumping the kill fluid into the well to kill the well can include pumping the control fluid from the drill pipe, through the pump line, and into the subsea well.

In one or more embodiments, the method can include cementing the subsea well after hydrostatic or other types of well control is established. The method can include a combination of pumping drilling fluids and cement or reactive chemicals that will affect a well control and pressure seal.

Turning now to the Figures, FIG. 1 depicts a schematic of a normal arrangement of a subsea BOP that includes a BOP stack 4, an LMRP 100, and a marine riser 11.

The LMRP 100 can be disconnected in an emergency, such as a blowout, impending storm, hurricane, equipment malfunction and/or ice flow.

The LMRP 100 can have a connector 5 that can be connected to the BOP stack 4.

The BOP stack 4 can be connected by a bottom connector 3 to a subsea wellhead 2. The subsea wellhead 2 can have a well casing 1.

The LMRP 100 can include a lower annular preventer 8, an upper annular preventer 9, LMRP accumulator bottles 6, and a flex joint 10.

A MUX cable 12 and an accumulator hot line 13 can be in communication with the LMRP accumulator bottles 6.

Figure 2:
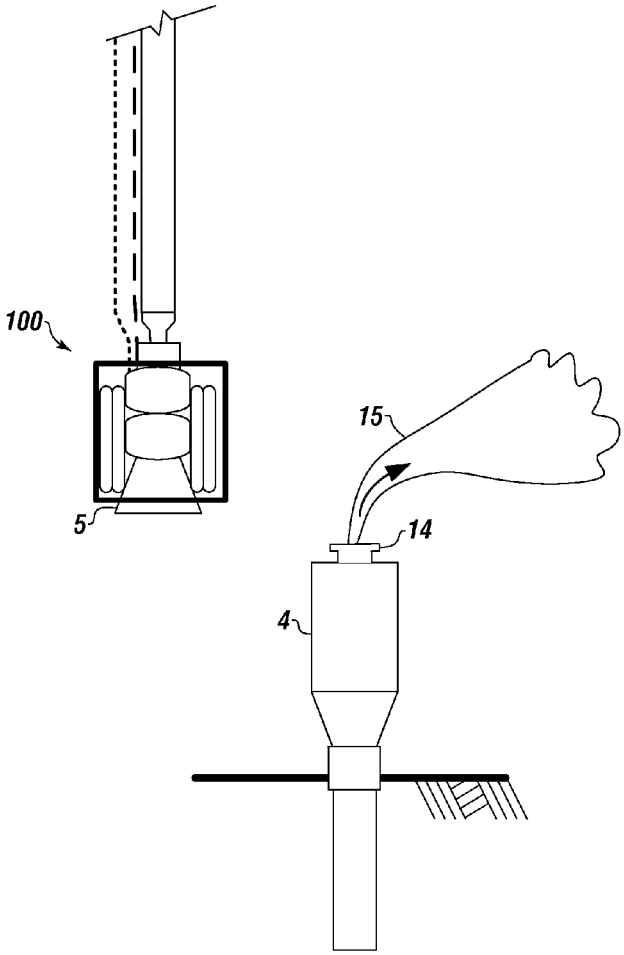
FIGURE 2 PRIOR ART
FIG. 2 depicts a schematic of a leaking blowout preventer after an emergency required disconnection of the lower marine riser package.

FIG. 2 depicts a schematic of a leaking subsea BOP after an emergency required disconnection of the LMRP 100.

The LMRP 100 can be disconnected from the BOP stack 4 by disconnecting the connector 5 from a male marine mandrel connector 14.

An effluent 15 can escape from the BOP stack 4.

After the LMRP 100 is removed from the BOP stack 4 by the MODU, which is not shown, it can be moved to a position so that the effluent does not impinge on any of the MODU equipment.

Figure 3:
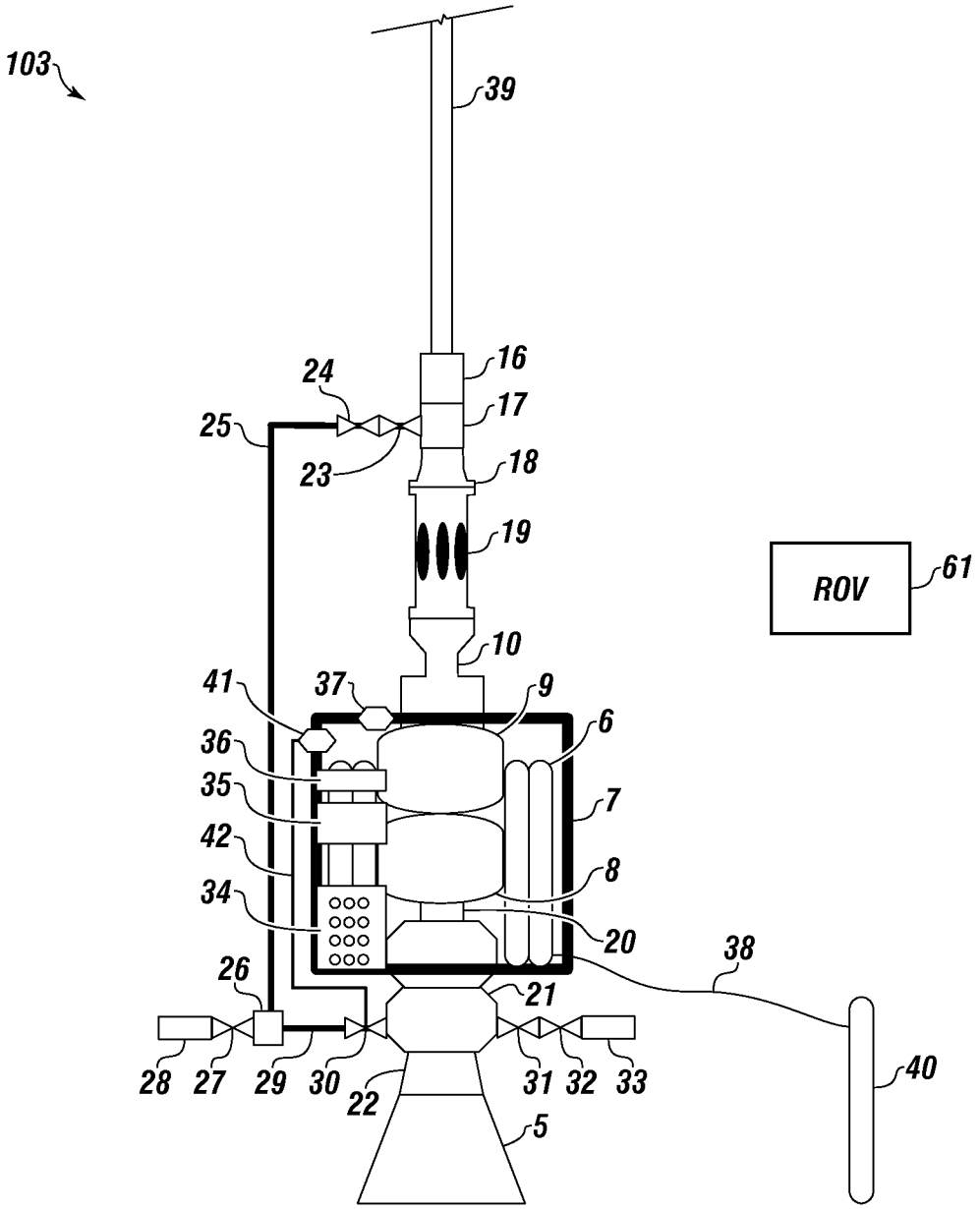
FIG. 3 depicts a lower marine riser package capping system according to one or more embodiments.

FIG. 3 depicts the lower marine riser package capping system according to one or more embodiments.

The lower marine riser package capping system 103 can have a frame 7, a lower annular preventer 8, an upper annular preventer 9, or only one single annular, a flex joint 10, and a capping blowout preventer 21.

The lower annular preventer 8, the upper annular preventer 9, and the flex joint 10 can be connected to the capping blowout preventer 21 via a middle crossover 20.

The lower marine riser package capping system 103 can include the connector 5. The connector 5 can be configured to operatively connect with a subsea BOP.

The capping blowout preventer 21 can be connected with the connector 5. For example, a lower crossover 22 can be used to connect the capping blowout preventer 21 with the connector 5.

A diverter line 29 can be in fluid communication with the capping blowout preventer 21.

A first choke 28, an outboard first diverter valve 27 and an inboard first diverter valve 30 can be opened to divert pressure and flow to a first side of the lower marine riser package capping system 103. A second choke 33, an inboard second diverter valve 31 and an outboard second diverter valve 32 can be opened to divert pressure and flow to a second side of the lower marine riser package capping system 103.

A slotted riser diverter section 19 can be connected with a top of the flex joint 10. The slotted riser diverter section 19 can be a short riser section with a large flow area.

An upper crossover 18 can be used to connect the slotted riser diverter section 19 with an upper flow cross 17.

The upper flow cross 17 can provide fluid communication between a drill pipe 39 and a pump line 25. The upper flow cross 17 can connect to an inboard pump line valve 23. An outboard pump line valve 24 can be connected with the inboard pump line valve 23. The pump line 25 can be connected with the outboard pump line valve 24.

A top of the upper flow cross 17 can connect to a bottom of an emergency disconnect tool 16. The emergency disconnect tool 16 can connect with the drill pipe 39 and an upper section of the upper flow cross 17.

The pump line 25 can be in fluid communication with the diverter line 29 via a lower flow cross 26.

The pump line 25 can be placed in communication with the drill pipe by the selective actuation of the inboard pump line valve 23 and the outboard pump line valve 24.

The pump line 25 can be placed in communication with the wellbore by closing the outboard first diverter valve 27 and opening the inboard first diverter valve 30.

A remote operated vehicle panel 34 can be operatively secured to the frame 7. The remote operated vehicle panel 34 can be configured to allow a remote operated vehicle 61 to actuate the first choke 28, the capping blowout preventer 21, the outboard first diverter valve 27, the inboard first diverter valve 30, the outboard second diverter valve 32, the inboard second diverter valve 31, the outboard pump line valve 24, the inboard pump line valve 23, or combinations thereof.

The lower marine riser package capping system 103 can include an acoustic control panel 35, an acoustic pressure and temperature system 36, a chemical injection port 41 and a receptacle 37, which can be a remote operated vehicle recharge receptacle. The chemical injection port 41 can be connected to the diverter line 29 by an injection line 42.

LMRP accumulator bottles 6 can be connected with the frame 7. The capping blowout preventer 21 can be actuated using hydraulic fluid under pressure that can be sourced from the LMRP accumulator bottles 6. A connection hose 38 can connect a secondary accumulator 40 with the LMRP accumulator bottles 6.

The LMRP accumulator bottles 6 can be recharged using the secondary accumulator 40 or the receptacle 37, which can be a remote operated vehicle recharge receptacle.

Figures 4, 5, 6, 7, 8, 9:
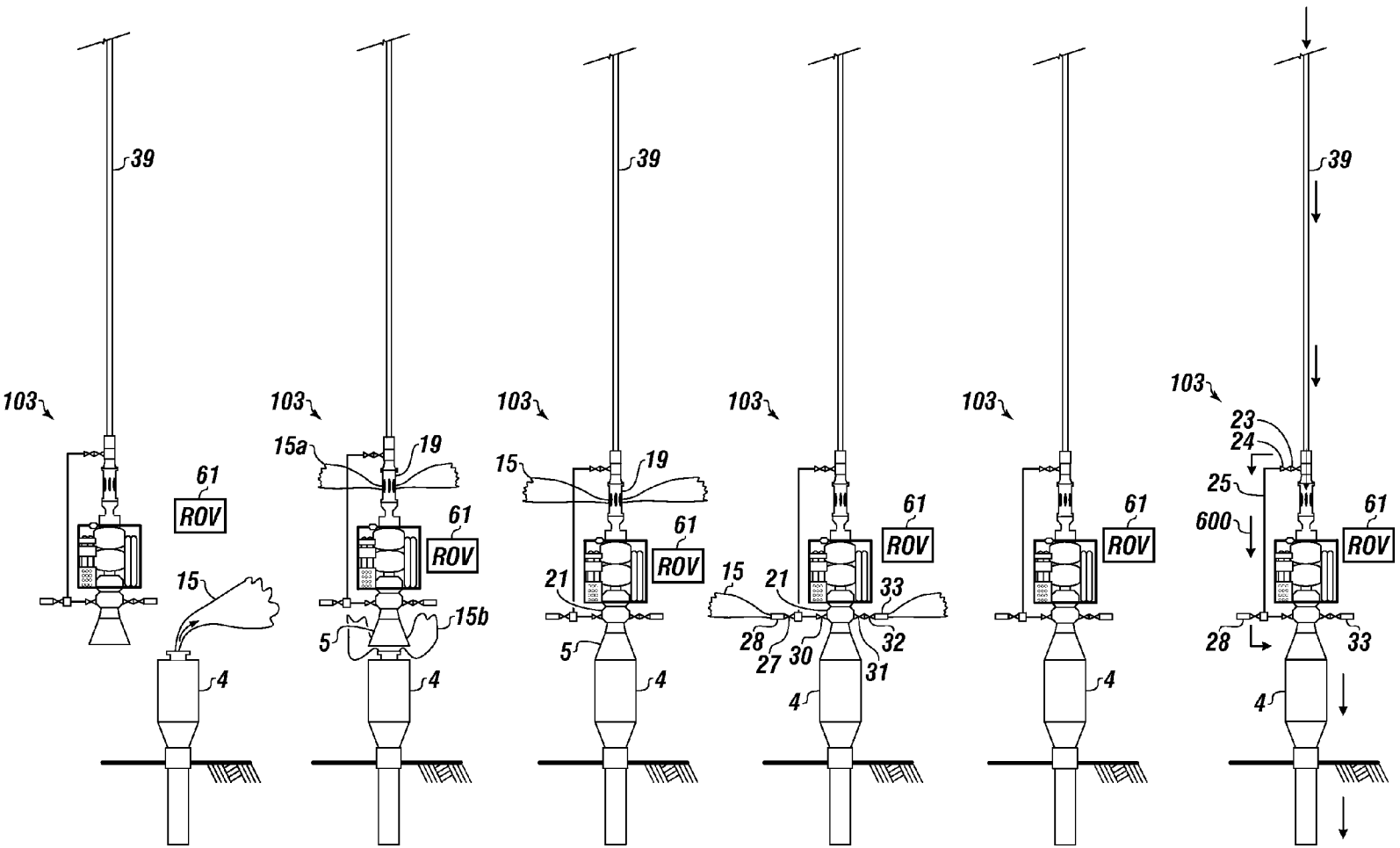
FIG. 4 depicts the lower marine riser package capping system positioned at a vertical position above and slightly offset to a subsea blowout preventer where a well is blowing out.
FIG. 5 depicts the lower marine riser package capping system operatively aligned with the blowout preventer in an aligned in a position that allows re-attachment via a marine connector.
FIG. 6 depicts the lower marine riser package capping system engaged with the blowout preventer via a marine connector and fluid flowing out a slotted riser diverter section in the upper part of the LMRP capping system.
FIG. 7 depicts the lower marine riser package capping system connected to the blowout preventer with a double cavity blowout protector actuated and fluid flowing out of one or more diverter lines.
FIG. 8 depicts the lower marine riser package capping system with all valves and rams in a closed position and the lower marine riser package capping system containing wellhead pressure and flow which may or may not be initiated depending on well conditions.
FIG. 9 depicts the lower marine riser package capping system being utilized for pumping kill fluid into the blowout preventer, which in turn places the kill fluid, or reactive chemical and/or cement into the well for hydrostatic or any other means of control purposes.

FIG. 4 depicts the lower marine riser package capping system 103 positioned at a vertical position offset from a BOP stack 4 where the well is blowing out.

The lower marine riser package capping system 103 can be connected to the drill pipe 39 and run down until at a vertical position offset from the BOP stack 4.

The BOP stack 4 can have effluent 15 escaping therefrom.

The drill pipe 39 can be connected with the MODU (not shown) that has been moved away from the BOP stack 4.

The remote operated vehicle 61 can send signals to the surface showing the position of the lower marine riser package capping system 103.

FIG. 5 depicts the lower marine riser package capping system 103 operatively aligned with the BOP stack 4 in preparation for making the connection of the LMRP to the subsea BOP.

The lower marine riser package capping system 103 can be at an elevation that the lowest most section of the connector 5 will clear a top of a mandrel of a BOP connector by approximately one foot.

The MODU (not shown) can be moved to operatively align the lower marine riser package capping system 103 with the BOP stack 4.

At least a first portion of the effluent 15*a* can flow out of the BOP stack 4 and pass through the lower marine riser package capping system 103 via the slotted riser diverter section 19.

A second portion of the effluent 15*b* can also flow out of the BOP stack 4 and escape through a space between the lower marine riser package capping system 103 and the BOP stack 4.

The remote operated vehicle 61 can aid in guiding the lower marine riser package capping system 103.

FIG. 6 depicts the lower marine riser package capping system 103 engaged with the BOP stack 4.

The lower marine riser package capping system 103 can be lowered using the drill pipe 39, and the connector 5 can be connected with the BOP stack 4.

The effluent 15 can pass through a first flow path in the lower marine riser package capping system 103. The flow path can be through the capping blowout preventer 21 and the slotted riser diverter section 19.

The remote operated vehicle 61 can monitor the operations of the lower marine riser package capping system 103.

FIG. 7 depicts the lower marine riser package capping system 103 connected to the BOP stack 4 with the capping blowout preventer 21 actuated by the remote operated vehicle 61 and effluent 15 flowing out of a diversion flow path in the lower marine riser package capping system 103.

One or more diversion flow paths can be formed using the first choke 28, the second choke 33, the outboard first diverter valve 27, the outboard second diverter valve 32, the inboard first diverter valve 30, and the inboard second diverter valve 31.

For example, the first choke 28, the outboard first diverter valve 27 and the inboard first diverter valve 30 can be actuated by the remote operated vehicle 61 to the open position. Also, the outboard second diverter valve 32, the inboard second diverter valve 31, and the second choke 33 can be in the open position so that there is pressure and flow communication to the sea from the capping blowout preventer 21, allowing for diversion of the effluent 15 to the sea.

The first choke 28 and second choke 33 can be selectively actuated by the remote operated vehicle 61 to control the flow rate of the effluent.

The capping blowout preventer 21 can have two double blind rams that can be closed by the remote operated vehicle 61 to blank off the bore of the capping blowout preventer. Fluid communication between the slotted riser diverter section 19 and the BOP stack 4 is eliminated when the double blind rams are closed.

The pressure and flow of the first portion of the effluent 15 and the second portion of the effluent 15 can be monitored via a camera on the remote operated vehicle 61 and via the acoustic pressure and temperature system.

FIG. 8 depicts the lower marine riser package capping system 103 with all valves and rams in the closed position, and with the lower marine riser package capping system 103 containing wellhead pressure and flow. For example, the lower marine riser package capping system 103 can be fully shut-in with no flow of effluent into the environment from the BOP stack 4.

The remote operated vehicle 61 can monitor the operations of the lower marine riser package capping system 103.

FIG. 9 depicts the lower marine riser package capping system 103 being utilized for pumping fluid 600 into the BOP stack 4, which can in-turn place the fluid 600 into the well for hydrostatic control purposes. Hydrostatic control is that situation where the pressure created by the fluid in the well which overcomes the reservoir pressure creating a no flow condition.

The fluid 600 can be kill fluid, drill fluid, reactive chemicals, cement, the like, or combinations thereof which can achieve well control by means other than hydrostatic control.

The first choke 28 and second choke 33 can be closed to stop the flow of the effluent out of the lower marine riser package capping system 103.

The fluid 600 or reactive type fluids can be pumped from the MODU through the drill pipe 39. The fluid 600 can pass through the inboard pump line valve 23 and the outboard pump line valve 24 to the pump line 25.

The fluid 600 can then flow into the BOP stack 4. The fluid 600 can be pumped in the same manner until the subsea well is killed.

The remote operated vehicle 61 can monitor the operations of the lower marine riser package capping system 103.

Figure 10:
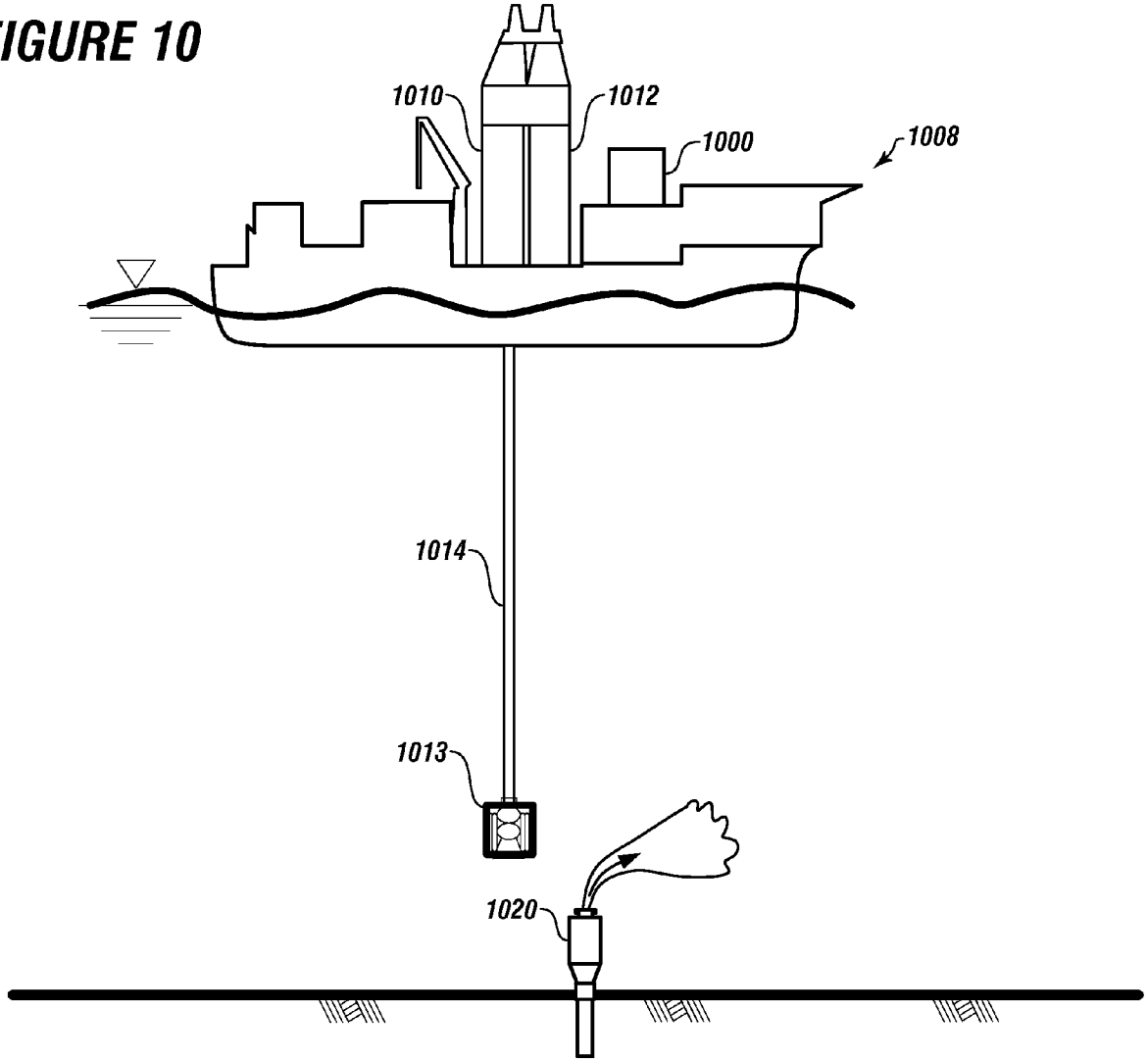
FIG. 10 depicts a dual mast MODU that has a riser with a LMRP disconnected from a BOP stack that is blowing out.

FIG. 10 depicts a dual MODU that has a riser with a LMRP disconnected from a BOP stack that is blowing out.

The dual mast MODU 1008 can be performing operations on a well and be in communication with a BOP stack 1020. The dual mast MODU 1008 can include a main mast 1010 and an auxiliary mast 1012.

The dual mast MODU 1008 can be connected with the LMRP 1013 via a first riser 1014 connected with the main mast 1010.

If the BOP stack 1020 blows out, the LMRP 1013 can be disconnected from the BOP stack 1020. The dual mast MODU 1008 can be moved away from the BOP stack 1020.

A capping system 1000, which can be substantially similar to the lower marine riser capping system described above, can be constructed or available on the dual mast MODU 1008.

Figure 11:
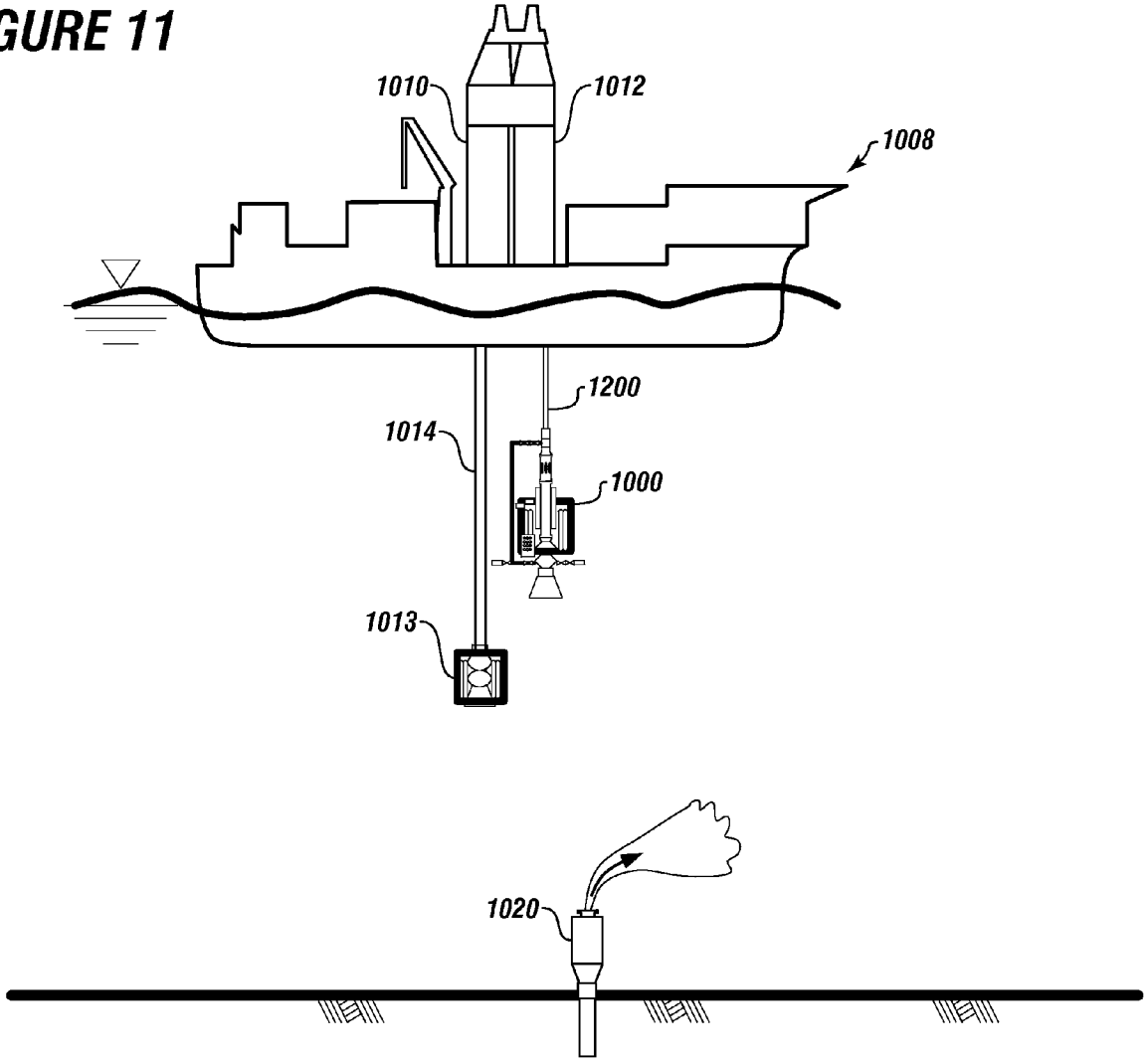
FIG. 11 depicts the capping system being lowered as the first LMRP is retrieved.

FIG. 11 depicts the capping system being lowered as the first LMRP is retrieved.

The capping system 1000 can be connected with a second riser 1200 and deployed using the auxiliary mast 1012. At the same time, the LMRP 1013 and the first riser 1014 can be retrieved and stored onboard using the main mast 1010.

The dual mast MODU 1008 and the BOP stack 1020 are also shown.

Figure 12:
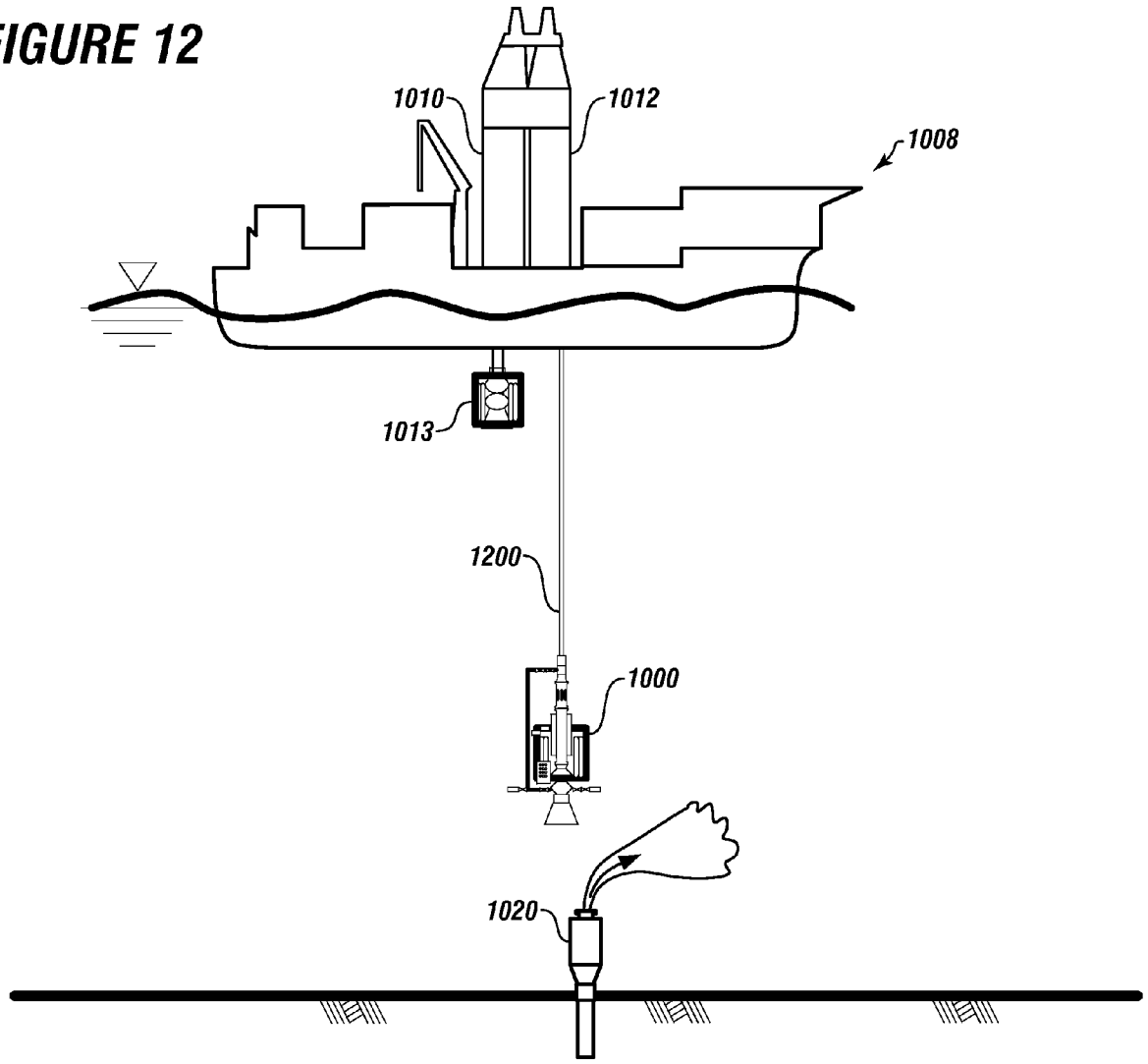
FIG. 12 depicts the capping system aligned with the BOP stack and ready to be moved over the BOP stack and connected thereto and the LMRP in a retrieved position.

FIG. 12 depicts the capping system aligned with the BOP stack and ready to be moved over the BOP stack and connected thereto and the LMRP in a retrieved position.

The first riser can be retrieved and stowed using techniques known in the art. The LMRP 1013 can also be in a stowed position.

The second riser 1200 can be lowered to align the capping system 1000 with the BOP stack 1020.

The steps of connecting the lower marine riser package capping system can be substantially similar to those described herein.

The dual mast MODU 1008 with a main mast 1010 and an auxiliary mast 1012 is also shown.

FIG. 13 is a diagram depicting the steps of the present method.

The method can include disconnecting a riser from a subsea well after a blowout has occurred, as illustrated in box 1302.

The method can include moving a mobile offshore drilling unit a short distance away from the subsea well, as illustrated in box 1304.

The method can include pulling the riser and a connected lower marine package system onto the mobile offshore drilling unit, as illustrated in box 1306.

The method can include modifying a lower marine riser package into a lower marine riser package capping system using common existing equipment, as illustrated in box 1308.

The method can include running the lower marine riser package capping system on a drill pipe to an initial position near the seabed, wherein the lower marine riser package capping system on the drill pipe is vertically positioned above a blowout connector of a blowout preventer connected to the subsea well blowout in the initial position, in the initial position the lower marine riser package capping system on the drill pipe is offset horizontally from the blowout connector of the blowout preventer, as illustrated in box 1310.

The method can include moving the mobile offshore drilling unit over the subsea well to operatively align the lower marine riser package capping system with the blowout preventer, as illustrated in box 1312.

The method can include operatively engaging the lower marine riser package capping system with the blowout preventer, as illustrated in box 1314.

The method can include allowing an effluent to flow through a first flow path in the lower marine riser package capping system when the lower marine riser package capping system is engaged with the blowout preventer, as illustrated in box 1316.

The method can include allowing the effluent to flow through a diversion flow path in the lower marine riser package capping system, as illustrated in box 1318.

The method can include stopping the effluent from flowing through the first flow path of the lower marine riser package capping system, as illustrated in box 1320.

The method can include observing diversion of the effluent flow and pressure through the lower marine riser package capping system, as illustrated in box 1322.

The method can include closing off at least a portion and/or blanking off the diversion flow path, as illustrated in box 1324.

The method can include pumping fluid into the subsea well to kill the subsea well blowout, as illustrated in box 1326.

While these embodiments have been described with emphasis on the embodiments, it should be understood that within the scope of the appended claims, the embodiments might be practiced other than as specifically described herein.

What is claimed is:

1. A method for rapid containment and intervention of a subsea well blowout on a seabed, wherein the method comprises:

a. disconnecting a riser from a subsea well after a blowout has occurred;

b. moving a mobile offshore drilling unit a short distance away from the subsea well;

c. pulling the riser and a connected lower marine package system onto the mobile offshore drilling unit;

d. modifying a lower marine riser package into a lower marine riser package capping system;

e. running the lower marine riser package capping system on a drill pipe to an initial position near the seabed, wherein the lower marine riser package capping system on the drill pipe is vertically positioned above a blowout connector of a blowout preventer connected to the subsea well blowout in the initial position, in the initial position the lower marine riser package capping system on the drill pipe is offset horizontally from the blowout connector of the blowout preventer;

f. moving the mobile offshore drilling unit over the subsea well to operatively align the lower marine riser package capping system with the blowout preventer;

g. operatively engaging the lower marine riser package capping system with the blowout preventer;

h. allowing an effluent to flow through a first flow path in the lower marine riser package capping system when the lower marine riser package capping system is engaged with the blowout preventer;

i. allowing the effluent to flow through a diversion flow path in the lower marine riser package capping system;

j. stopping the effluent from flowing through the first flow path of the lower marine riser package capping system;

k. observing diversion of the effluent flow and pressure through the lower marine riser package capping system;

l. closing off at least a portion and/or blanking off the diversion flow path; and m. pumping fluid into the subsea well to kill the subsea well blowout.

2. The method for rapid containment and intervention of the subsea well blowout of claim 1, wherein the lower marine riser package capping system comprises:

a. a connector configured to connect to the blowout preventer;

b. a capping blowout preventer attached to the connector;

c. an inboard first diverter valve connected with the capping blowout preventer;

d. a diverter line in fluid communication with the inboard first diverter valve;

e. a lower flow cross connected with the diverter line;

f. a first choke connected with the diverter line via the lower flow cross;

g. an outboard first diverter valve connected with the lower flow cross, wherein the first choke is connected with the outboard first diverter valve;

h. an inboard second diverter valve in fluid communication with the capping blowout preventer;

i. an outboard second diverter valve adjacent and in fluid communication with the inboard second diverter valve;

j. a second choke adjacent and in fluid communication with the outboard second diverter valve;

k. a slotted riser diverter section in fluid communication with the capping blowout preventer;

l. an outboard pump line valve connected with an inboard pump line valve, wherein the inboard pump line valve is connected with the slotted riser diverter section, wherein the inboard pump line valve is in fluid communication with the drill pipe;

m. a pump line in communication with the outboard pump line valve;

n. an acoustic pressure and temperature system to control the capping blowout preventer, the chokes, the diverter valves, and the pump line valves, and wherein the acoustic pressure and temperature system is configured to obtain pressure and temperature data on the effluent passing though the diverter line, the pump line valves, and the second choke;

o. a remote operated vehicle panel to control the capping blowout preventer, the chokes, the diverter valves, and the pump line valves;

p. lower marine riser package accumulator bottles operatively connected with the capping blowout preventer, the chokes, the diverter valves, the pump line valves, wherein the lower marine riser package accumulator bottles provide fluid under pressure to actuate the capping blowout preventer, the chokes, the diverter valves, and the pump line valves;

q. an emergency disconnect tool connected with an upper flow cross and the drill pipe; and r. a receptacle where chemicals can be injected to prevent hydrate formation or any other chemical process that is required for the control of well operation.

3. The method for rapid containment and intervention of the subsea well blowout of claim 2, further comprising using a remote operated vehicle to send video signals to a surface from a camera of the remote operated vehicle, observe gauges on the lower marine riser package capping system, operate functions of the lower marine riser package capping system by interacting with the remote operated vehicle panel, recharge the lower marine riser package accumulator bottles, or inject chemicals to reduce hydrate formation.

4. The method for rapid containment and intervention of the subsea well blowout of claim 2, wherein stopping flow through the first flow path comprises closing the capping blowout preventer and opening the first choke, the diverter valves, and the second choke to form the diversion flow path for the effluent to escape the capping blowout preventer.

5. The method for rapid containment and intervention of the subsea well blowout of claim 2, wherein stopping the effluent flow through the diversion flow path comprises closing the first choke and the second choke and subsequently closing the outboard first diverter valve, the outboard second diverter valve, and the inboard first diverter valve.

6. The method for rapid containment and intervention of the subsea well blowout of claim 2, wherein pumping fluid into the subsea well to control or stop the subsea well blowout comprises pumping fluid from the drill pipe through the pump line into the subsea well.

7. The method for rapid containment and intervention of the subsea well blowout of claim 6, further comprising pumping cement, reactive chemicals, or both into the subsea well via the drill pipe and the pump line.

8. A capping system for rapid containment and intervention of a subsea well blowout comprising:

a. a connector configured to connect to a blowout preventer connected with the subsea well;

b. a capping blowout preventer attached to the connector;

c. an inboard first diverter valve connected with the capping blowout preventer;

d. a diverter line in fluid communication with the inboard first diverter valve;

e. a lower flow cross connected with the diverter line;

f. a first choke connected with the diverter line via the lower flow cross;

g. an outboard first diverter valve connected with the lower flow cross, wherein the first choke is connected with the outboard first diverter valve;

h. an inboard second diverter valve in fluid communication with the capping blowout preventer;

i. an outboard second diverter valve adjacent and in fluid communication with the inboard second diverter valve;

a second choke adjacent and in fluid communication with the outboard second diverter valve;

k. a slotted riser diverter section in fluid communication with the capping blowout preventer;

l. a pump line in communication with an outboard pump line valve;

m. an acoustic pressure and temperature system configured to acquire data and transmit data on well conditions;

n. a remote operated vehicle panel to control the capping blowout preventer, the chokes, the diverter valves, the pump line valves, and the connector;

o. lower marine riser package accumulator bottles operatively connected with the capping blowout preventer, the chokes, the diverter valves, the pump line valves, wherein the lower marine riser package accumulator bottles provides fluid under pressure to actuate the capping blowout preventer, the chokes, the diverter valves, and the pump line valves;

p. an emergency disconnect tool connected with an upper flow cross and a drill pipe; and q. an inboard pump line valve connected with the outboard pump line valve, wherein the inboard pump line valve is connected with the slotted riser diverter section, wherein the inboard pump line valve is in fluid communication with the upper flow cross.

9. The system for rapid containment and intervention of a subsea well blowout of claim 8, further comprising using a remote operated vehicle to send video signals to a surface from a camera of the remote operated vehicle, observe gauges on the lower marine riser package capping system, operate functions of the lower marine riser package capping system by interacting with the remote operated vehicle panel, recharge the lower marine riser package accumulator bottles, and inject chemicals to reduce hydrate formation.

10. A capping system for rapid containment and intervention of a subsea well blowout comprising:

a. a capping blowout preventer configured to connect with a blowout preventer connected to a wellhead;

b. a slotted riser diverter section in fluid communication with the capping blowout preventer;

c. at least one diversion flow path in fluid communication with the capping blowout preventer;

d. a pump line in fluid communication with the capping blowout preventer and a drill pipe, wherein the drill pipe is connected with the slotted riser diverter section and used to deploy the capping system;

e. an acoustic pressure and temperature system configured to acquire data and transmit data on well conditions; and f. a remote operated vehicle panel to control the capping blowout preventer, the pump line and the diversion flow path.

* * * * *